United States Patent [19]

Donaldson et al.

[11] 3,949,108

[45] Apr. 6, 1976

[54] PROCESS FOR PRODUCING FIRE RESISTANT ORGANIC TEXTILE MATERIALS

[75] Inventors: Darrell J. Donaldson; Floyd L. Normand; George L. Drake, Jr.; Wilson A. Reeves, all of Metairie, La.

[73] Assignee: The United States of America as represented by the Secretary of Agriculture, Washington, D.C.

[22] Filed: June 1, 1973

[21] Appl. No.: 365,895

[52] U.S. Cl. ..... 427/380; 427/382; 427/392; 427/396; 428/921

[51] Int. Cl.[2] ..... C09K 3/28

[58] Field of Search..... 117/136, 137, 139.5 A, 117/143 A, 161 UF, 161 LN; 252/8.1; 106/15 FP; 428/921; 427/372, 382, 385, 392, 396, 380, 381

[56] References Cited

UNITED STATES PATENTS

| | | | |
|---|---|---|---|
| 3,054,698 | 9/1962 | Wagner | 117/136 |
| 3,144,299 | 8/1964 | Frich et al. | 117/139.4 |
| 3,186,868 | 6/1965 | Hirshfeld | 106/15 FP |
| 3,220,869 | 11/1965 | Ruemens | 117/139.4 |
| 3,243,391 | 3/1966 | Wagner | 117/137 |
| 3,335,113 | 8/1967 | Dundon | 117/139.4 |
| 3,368,916 | 2/1968 | Hattori | 117/136 |
| 3,470,116 | 9/1969 | Praetzel et al. | 260/2.5 |
| 3,660,346 | 5/1972 | Gray et al. | 117/136 |
| 3,671,303 | 6/1972 | Meitner | 117/136 |
| 3,738,859 | 6/1973 | Anderson et al. | 117/136 |
| 3,740,264 | 6/1973 | Lynch et al. | 117/136 |

FOREIGN PATENTS OR APPLICATIONS

| | | | |
|---|---|---|---|
| 975,970 | 11/1964 | United Kingdom | 117/136 |

OTHER PUBLICATIONS

Some Chem. & Physical Factors Influencing Fame Retardancy, Reeves et al., Textile Research J., 40(3) 1970.

Chem. Abst. Vol. 65, 1966 10678 J.

Chem. Abst. Vol. 70, 1969 38508e.

*Primary Examiner*—Daniel J. Fritsch

*Attorney, Agent, or Firm*—M. Howard Silverstein; Max D. Hensley

[57] ABSTRACT

Organic fibrous materials especially cellulosic and other textiles are rendered flame resistant upon treatment with an emulsion containing either (1) an organic bromine containing material having at least 65% bromine such as polyvinylbromide, (2) polyvinylbromide and an N-methylol agent such as trimethylolmethylglycoluril, (3) polyvinylbromide and a metal oxide such as antimony oxide, and (4) polyvinylbromide, N-methylol agent and metal oxide. The emulsions are applied to various fibers by the pad-dry-cure technique. The finish contained the added quality of wrinkle resistance and rot resistance. The treated textiles, including polyester/cotton blends remain highly flame resistant through innumerable laundry cycles.

11 Claims, No Drawings

PROCESS FOR PRODUCING FIRE RESISTANT ORGANIC TEXTILE MATERIALS

A non-exclusive, irrevocable, royalty-free license in the invention herein described, throughout the world for all purposes of the United States Government, with the power to grant sublicenses for such purposes, is hereby granted to the Government of the United States of America.

Related copending application Ser. No. 365,896, filed June 1, 1973, now abandoned discloses impregnating fibrous materials with an aqueous emulsion containing a tetrakis(hydroxymethyl)phosphonium salt, an amide, an acid catalyst and polyvinylbromide, followed by drying and curing.

Related copending application Ser. No. 265,862, filed June 23, 1972, now U.S. Pat. No. 3,915,915, discloses impregnating textile with a formulation containing tris(hydroxymethyl)phosphine urea 2:1 adduct and polyvinylbromide, followed by drying and curing.

This invention relates to a process for rendering textiles flame resistant; more specifically, this invention relates to a process for reducing flammability of organic fibrous material by treatment with one of several emulsions containing the elements of bromine, bromine and nitrogen, bromine and metal, or bromine, nitrogen and metal. Textile products treated by the process of the instant invention are durable to repeated launderings. The treated products are useful in the home, office, etc., in the form of drapes, sheets, upholstery, garments, etc.

The main objective of this invention is to provide a new method for rendering textiles flame resistant.

It is known that tetrakis (hydroxymethyl) phosphonium compounds react with amides to impart flame resistance to cellulosic materials and wool. It is also known that certain halogenated compounds impart flame resistance to cellulosics. The halogenated products of the prior inventions belong to the following classes:

1. Polybromo-alcohol neutral esters of phosphonitrilic halides disclosed in U.S. Pat. No. 2,681,295.

2. Polymeric addition products of $C_{1-2}$ polyhalohydrocarbons containing at least 2 atoms of the groups bromine and chlorine attached to the same carbon atom and a terminally unsaturated alkenol ester of phosphorus nitrilic halides disclosed in U.S. Pat. No. 2,825,718.

3. Analagous polymeric addition products of terminally unsaturated N-alkenylated melamines disclosed in U.S. Pat. No. 2,861,901.

4. Polymeric addition products of polybromo hydrocarbons and polymerizable aliphatic acrylamides disclosed in U.S. Pat. No. 2,861,901.

5. Polymeric addition products of polybromohydrocarbons and polymerizable trialkenyl phosphates disclosed in U.S. Pat. Nos. 2,778,747; 2,686,768 and 2,686,769.

6. Brominated polymers of triallyl phosphate and the like bromine containing polymers of unsaturated phosphate disclosed in U.S. Pat. Nos. 2,660,524 and 2,660,543.

These materials all contain at least 10% of bromine but not more than about 52% in the form of bromine atoms attached to carbon atoms.

We have found that a brominated thermoplastic polymer which contains at least 65% bromine such as polyvinylbromide will flameproof not only certain cellulosic fibers but also certain thermoplastic fibers and any blend combination of the cellulosic fibers with the thermoplastic fibers.

Further we have found that combining a brominated thermoplastic polymer which contains at least 65% bromine with N-methylol agents such as TMMGU or by combining said brominated thermoplastic polymer with a metal oxide such as antimony oxide, or combining said brominated thermoplastic polymer with N-methylol agents and metal oxides will flameproof not only certain cellulosic fibers but also certain thermoplastic fibers and any blend combination of the cellulosic fibers with the thermoplastic fibers.

In general, the invention consists of (a) impregnating an organic fibrous structure with a liquid containing polyvinylbromide (PVBr) or PVBr and an N-methylolamide, or PVBr and a metal oxide, or PVBr, an N-methylolamide and a metal oxide, (b) drying and then heating the impregnated fibrous material to produce in the fibrous structure insoluble polymeric materials which contain bromine, bromine and nitrogen, bromine and metal, or bromine, nitrogen and metal.

Specifically the invention consists of producing flame resistant organic fibrous structures by (a) impregnating a fibrous organic structure by any convenient technique, such as by padding, to a wet pickup of about 50 to 100% with an emulsion containing either polyvinylbromide alone in a percentage of 4 to 42%; or polyvinylbromide in combination with a metal oxide such as antimony oxide in a ratio of from about 1:0.5 to about 1:8 oxide to PVBr; or polyvinylbromide in combination with a nitrogenous agent such as TMGU in the ratio of about 1:1 to about 1:5 of TMGU to PVBr; or polyvinylbromide in combination with a nitrogenous agent and metal oxide in the ratio of about 1:1:1 to 1:1:5 of oxide/nitrogenous agent/PVBr, (b) drying the impregnated organic structure at a temperature of about 50°C to about 110°C for from about 1 to 10 minutes then heating to a temperature of from about 110°C to about 180°C for from about 1 to 10 minutes to produce in the fibrous structure insoluble flame resistant polymeric materials which contain bromine, bromine and nitrogen, bromine and metal, or bromine, nitrogen and metal.

The emulsion or solution used to impregnate fibrous materials is prepared as follows: An emulsion of polyvinylbromide (PVBr) is prepared to contain PVBr to the extent of about 1–42%, the preferred range being 4–25%. This liquid as used to treat fibrous organic materials is an emulsion.

The emulsion as used to treat organic fibrous materials may also advantageously contain N-methylol amides which can be polymerized or reacted with cellulose in a pH range of about 4 to 7. These amides may be present in the treating emulsion to the extent of about 1 to 10%. Suitable N-methylol amides are prepared by reacting formaldehyde with the amides of the group: methylglycoluril, glycoluril, urea, dihydroxyethyleneurea, melamines, triazones, triazines, and carbamates.

This emulsion as used to treat organic fibrous materials may also advantageously contain PVBr and metal oxide in the range from 2–42% PVBr and 2–20% metal oxide, the preferred range being 4–25% for the PVBr and 4–12% for the metal oxide.

This emulsion as used to treat organic fibrous materials may also advantageously contain the N-methylolamide and PVBr and also a metal oxide such as antimony oxide in the range of 2–20%, the preferred range being from 4–12%.

Surface active agents, water repellents, soil release agents and other conventional textile modifiers can be added to the treating emulsion.

Impregnated organic fibrous materials are dried and heated to an elevated temperature by any conventional manner such as an oven to produce an insoluble polymeric mixture in and on the fibers. It is of advantage to dry the textile at a temperature of about 50° to 120°C before it is cured at a temperature of about from 130° to 180°C for about from 1 to 10 minutes. The fabric can also be dried and cured in a single step at the temperature range of about 110° to 180°C.

After a textile fabric has been impregnated, dried and cured, it is desirable to rinse the fabric to remove any soluble material that may be present. Sometimes white or pastel color fabrics become discolored by the fire retardant finish. When this occurs, the discoloration can be removed easily by immersing the treated fabric in a mild bleach solution at about 30° to 60°C for about 5 to 90 seconds. Suitable bleach solution includes 1–5% sodium hypochlorite and 0.5 to 3% optical brightener.

The degree of flameproofing imparted to a textile by the polymeric mixture can be varied from a low degree to a very high degree by varying the amount of polymer deposited in the textile structure.

In this process the term organic fibrous material includes cellulosic fibers such as rayon, cotton, ramie, jute, paper, cardboard and their physical and chemical modifications and thermoplastic fibers such as polyester, polypropylene, polyamides, acrylics, and wool.

N-methylol amides suitable for use in this invention are prepared by reacting formaldehyde with the amides of the group: urea, thiourea, ethyleneurea, carbamates, dihydroxyethyleneurea, urone, glycoluril, methylglycoluril, melamine triazone, acetylene diurea, and triazines; however, the invention is not limited only to these.

The use of N-methylol compounds give to the treated fabric the added property of wrinkle and rot resistance.

Metal oxides suitable for use in this invention are antimony oxides and tin oxides; however, the invention is not limited to these oxides.

The vinylbromide polymers (PVBr) suitable for use in this invention are those which contain about 70% bromine and have a molecular weight of at least 2000. The PVBr is prepared by polymerizing vinylbromide in solvent or aqueous emulsion using free radical chemical initiators, cobalt 60 gamma radiation or other appropriate catalysts so long as the PVBr polymer has a molecular weight of at least 2000. The bromine containing polymers of this invention can also be obtained by copolymerizing a minor amount of other vinyl monomers such as acrylonitrile with the vinyl bromide. The polyvinylbromide solutions or emulsions can advantageously contain a heat stabilizing agent.

Textiles treated in accordance with this invention were tested in various manners, among which were the standard vertical flame test (AATCC Test Method 34-1966) and the angle match test by Guthrie et al. (see Textile Research J. 23, pages 527–32, 1953).

The following examples are provided to illustrate the significant details of the invention and should not be construed as limiting the invention in any manner whatever. The percent figures cited through the examples are based on weights.

EXAMPLE 1

A 50/50 polyester/cotton blend and a brushed 100% polyester textile were wetted with a solution consisting of 55 gms of 42% PVBr emulsion, 5 gms of trimethylolglycoluril (TMGU), 5 gms of $Sb_2O_3$, 0.1 gms of wetting agent and 34.9 gms of $H_2O$. The samples were dried at 85°C for 5 minutes and cured at 160°C for 1 minute; after hot water wash and oven drying, the fabric had a weight gain of 24.4% (add-on) and a 5.5 inch char length. The polyester fabric had a 25% add-on and a char length of 3.0 inches. The finish was durable to laundering.

EXAMPLE 2

Same as Example 1 except the metal oxide was not included in the emulsion. The blend fabric had a 20.3% add-on and passed the 90° angle match test. The polyester fabric had a 15.1% add-on and a 4.0 inch char length.

EXAMPLE 3

Same as Example 1 except dimethylolmethyl carbamate was substituted for TMGU. The blend had a 24.6% add-on and a char length of 5.7 inches. The polyester had a 21.1% add-on and a char length of 4.5 inches. The polyester fabric had a 244° conditioned wrinkle recovery angle and the blend a 210° conditioned wrinkle recovery angle.

EXAMPLE 4

Same as Example 2 except dimethylolmethyl carbamate replaced TMGU. The blend had a 19.7% add-on and a 45° angle match test and the polyester had a 12.7% add-on and passed the 90° match test angle.

EXAMPLE 5

Several organic fibrous materials listed in Table I were padded through a 42% polyvinylbromide emulsion containing 0.1% of a wetting agent. The samples were dried at 85°C for 5 minutes and cured at 160° for 2 minutes.

Table I

| Type fabric | Wet Pickup | % Add-on | Flame Test |
|---|---|---|---|
| Jute | 103 | 37.4 | 4.5 in SVFT[1] |
| Paper | 111 | 30.2 | 180° match test |
| Rayon/polyester blend | 106 | 32.7 | 3.5 in SVFT |
| Rayon/cotton blend | 94 | 38.5 | 8.0 in SVFT |
| Brushed nylon | 116 | 34.6 | 4.2 in SVFT |
| Polypropylene | 83 | 27.1 | 120° match test |
| Rayon | 67 | 24.3 | 0° match test[2] |
| Nylon/acetate blend | 89 | 31.6 | 180° match test |

[1]SVFT = AATCC Standard Vertical Flame Test
[2]Left a black char.

EXAMPLE 6

A 100% cotton sheeting, a 50/50 cotton polyester knit and 50/50 cotton polyester sheeting were padded with an emulsion containing 42% PVBr and 0.1% wetting agent. The fabrics were dried at 90°C and cured at 160°C for 1½ minutes. After hot water washing and oven drying, the all cotton had 31% add-on, the knit textile 34.1% add-on and the 50/50 polyester/cotton sheeting 37% add-on. All passed the 180° angle match test.

EXAMPLE 7

A 50/50 cotton/polyester sheeting and brushed 100% polyester textile were treated with an emulsion containing 40% of 42% emulsion of PVBr, 8% $Sb_2O_3$ and 52% $H_2O$. The samples were dried at 85°C for 4 minutes and cured at 160°C for 2 minutes. Both fabrics had about 21% add-on. The blend had a 90° angle match test and the polyester sample had a 135° angle match test.

EXAMPLE 8

A brushed 100% polyester fabric was padded with 20 gms of a 42% PVBr emulsion, 0.2 gms wetting agent and 79.8 gms $H_2O$. The sample was dried at 80°C for 5 minutes and cured at 160°C for 3 minutes. The sample had 3.9% add-on and passed the 90° angle match test.

We claim:

1. A process for preparing flame resistant organic fibrous materials comprising:

a. impregnating an organic textile to a wet pickup of about 50 to 100% by weight with an emulsion consisting essentially of polyvinylbromide at a percentage of 1 to 42% by weight in water, b. drying the impregnated organic textile (a); and c. curing the dried organic textile from (b) to produce in the fibrous structure an insoluble flame resistant polymeric material.

2. The process of claim 1 wherein said emulsion additionally contains a metal oxide in a weight ratio of oxide to polyvinylbromide of from about 1:0.5 to about 1:8.

3. The process of claim 2 wherein the metal oxide is tin oxide.

4. The process of claim 1 wherein said emulsion additionally contains a nitrogenous agent in a weight ratio of nitrogenous agent to polyvinylbromide of from about 1:1 to about 1:5.

5. The process of claim 4 wherein the nitrogenous agent is a compound selected from the group consisting of N-methylolamides of each of glycoluril, methylglycoluril, urea, dihydroxyethyleneurea, melamine, and carbamates.

6. The process of claim 1 wherein said emulsion additionally contains a metal oxide and a nitrogenous agent in a weight ratio of oxide to nitrogenous agent to polyvinylbromide from about 1:1:1 to 1:1:5, respectively.

7. The process of claim 6 wherein the metal oxide is antimony oxide or tin oxide and the nitrogenous agent is a compound selected from the group consisting of N-methylolamides of each of glycoluril, methylglycoluril, urea, dihydroxyethyleneurea, melamine, and carbamates.

8. The process of claim 6 wherein the drying and curing is done by drying at a temperature of from about 50°C to about 110°C for from about 1 minute to 10 minutes and curing at a temperature of from about 110°C to about 180° for 1 minute to 10 minutes.

9. The process of claim 1 wherein the drying and curing is done simultaneously by heating from about 130° to 180°C for 2 to 10 minutes.

10. The process of claim 1 wherein the textile is a cellulosic containing material.

11. The process of claim 1 wherein the cured textile is immersed in a mild bleach solution from 1 to 5 minutes.

* * * * *